US005082624A

United States Patent [19]

Huang

[11] Patent Number: 5,082,624

[45] Date of Patent: Jan. 21, 1992

[54] NIOBIUM CONTAINING TITANIUM ALUMINIDE RENDERED CASTABLE BY BORON INOCULATIONS

[75] Inventor: Shyh-Chin Huang, Latham, N.Y.

[73] Assignee: General Electric Company, Schenectady, N.Y.

[21] Appl. No.: 589,827

[22] Filed: Sep. 26, 1990

[51] Int. Cl.[5] ..... C22C 14/00

[52] U.S. Cl. ..... 420/418; 148/421; 420/421

[58] Field of Search ..... 420/418, 421; 148/421

[56] References Cited

U.S. PATENT DOCUMENTS 4,842,820 6/1989 Huang et al. ..... 420/421

FOREIGN PATENT DOCUMENTS 1298127 12/1989 Japan .

*Primary Examiner*—Upendra Roy

*Attorney, Agent, or Firm*—Paul E. Rochford; James C. Davis, Jr.; James Magee, Jr.

[57] ABSTRACT

A composition for providing improved castability in a gamma titanium aluminide is taught. The method involves adding inclusions of boron to the titanium aluminide containing higher concentrations of niobium. Boron additions are made in concentrations between 0.5 and 2 atomic percent. Fine grain equiaxed microstructure is found from solidified melt. Property improvements are also achieved.

12 Claims, 3 Drawing Sheets

NIOBIUM CONTAINING TITANIUM ALUMINIDE RENDERED CASTABLE BY BORON INOCULATIONS

CROSS REFERENCE TO RELATED APPLICATION

The present invention relates closely to application Ser. No. 07/445,306, filed Dec. 4, 1989; to applications Ser. No. 07/546,962 and Ser. No. 07/546,973, both filed July 2, 1990; and to application Ser. No. 07/589,823 filed 09/26/90. The text of the related applications are incorporated herein by reference.

BACKGROUND OF THE INVENTION

The present invention relates generally to gamma titanium aluminide (TiAl) alloys having improved castability in the sense of improved grain structure. More particularly, it relates to castings of niobium doped TiAl which achieves fine grain microstructure and a set of improved properties with the aid of combined niobium and boron additives.

In forming a casting, it is generally desirable to have highly fluid properties in the molten metal to be cast. Such fluidity permits the molten metal to flow more freely in a mold and to occupy portions of the mold which have thin dimensions and also to enter into intricate portions of the mold without premature freezing. In this regard, it is generally desirable that the liquid metal have a low viscosity so that it can enter portions of the mold having sharp corners and so that the cast product will match very closely the shape of the mold in which it was cast.

Another desirable feature of cast structures is that they have a fine microstructure, that is a fine grain size, so that the segregation of different ingredients of an alloy is minimized. This is important in avoiding metal shrinking in a mold in a manner which results in hot tearing. The occurrence of some shrinkage in a casting as the cast metal solidifies and cools is quite common and quite normal. However, where significant segregation of alloy components occurs, there is a danger that tears will appear in portions of the cast article which are weakened because of such segregation and which are subjected to strain as a result of the solidification and cooling of the metal and of the shrinkage which accompanies such cooling. In other words, it is desirable to have the liquid metal sufficiently fluid so that it completely fills the mold and enters all of the fine cavities within the mold, but it is also desirable that the metal once solidified be sound and not be characterized by weak portions developed because of excessive segregation or internal hot tearing.

With regard to the titanium aluminide itself, it is known that as aluminum is added to titanium metal in greater and greater proportions, the crystal form of the resultant titanium aluminum composition changes. Small percentages of aluminum go into solid solution in titanium and the crystal form remains that of alpha titanium. At higher concentrations of aluminum (including about 25 to 30 atomic percent) and intermetallic compound $Ti_3Al$ forms and it has an ordered hexagonal crystal form called alpha-2. At still higher concentrations of aluminum (including the range of 50 to 60 atomic percent aluminum) another intermetallic compound, TiAl, is formed having an ordered tetragonal crystal form called gamma. The gamma titanium aluminides are of primary interest in the subject application.

The alloy of titanium and aluminum having a gamma crystal form and a stoichiometric ratio of approximately 1, is an intermetallic compound having a high modulus, low density, a high thermal conductivity, a favorable oxidation resistance, and good creep resistance. The relationship between the modulus and temperature for TiAl compounds to other alloys of titanium and in relation to nickle base superalloys is shown in FIG. 1. As is evident from the Figure, the gamma TiAl has the best modulus of any of the titanium alloys. Not only is the gamma TiAl modulus higher at higher temperature, but the rate of decrease of the modulus with temperature increase is lower for gamma TiAl than for the other titanium alloys. Moreover, the gamma TiAl retains a useful modulus at temperatures above those at which the other titanium alloys become useless. Alloys which are based on the TiAl intermetallic compound are attractive, light-weight materials for use where high modulus is required at high temperatures and where good environmental protection is also required.

One of the characteristics of gamma TiAl which limits its actual application to such uses is a brittleness which is found to occur at room temperature. Another of the characteristics of gamma TiAl which limits its actual application is a relatively low fluidity of the molten composition. This low fluidity limits the castability of the alloy particularly where the casting involves thin wall sections and intricate structure having sharp angles and corners. Improvements of the gamma TiAl intermetallic compound to enhance fluidity of the melt as well as the attainment of fine microstructure in a cast product are very highly desirable in order to permit more extensive use of the cast compositions at the higher temperatures for which they are suitable. When reference is made herein to a fine microstructure in a cast TiAl product, the reference is to the microstructure of the product in the as-cast condition.

It is recognized that if the product is forged or otherwise mechanically worked following the casting, the microstructure can be altered and may be improved. However, for applications in which a cast product is useful, the microstructure must be attained in the product as cast and not through the application of supplemental mechanical working steps.

What is also sought and what is highly desirable in a cast product is a minimum ductility of more than 0.5%. Such a ductility is needed in order for the product to display an adequate integrity. A minimum room temperature strength for a composition to be generally useful is about 50 ksi or about 350 MPa. However, materials having this level of strength are of marginal utility and higher strengths are often preferred for many applications. The stoichiometric ratio of gamma TiAl compounds can vary over a range without altering the crystal structure. The aluminum content can vary from about 50 to about 60 atom percent. However, the properties of gamma TiAl compositions are subject to very significant changes as a result of relatively small changes of 1% or more in the stoichiometric ratio of the titanium and aluminum ingredients. Also, the properties are similarly affected by the addition of relatively small amounts of ternary and quaternary elements as additives or as doping agents.

PRIOR ART

There is extensive literature on the compositions of titanium aluminum including the $TiAl_3$ intermetallic compound, the gamma TiAl intermetallic compounds and the $Ti_3Al$ intermetallic compound. A patent, U.S. Pat. No. 4,294,615, entitled "Titanium Alloys of the TiAl Type" contains an intensive discussion of the titanium aluminide type alloys including the gamma TiAl intermetallic compound. As is pointed out in the patent in column 1, starting at line 50, in discussing the advantages and disadvantages of gamma TiAl relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the gamma alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of Ti3Al resembles that of titanium, as the hexagonal crystal structures are very similar. However, the compound TiAl has a tetragonal arrangement of atoms and thus rather different alloying characteristics. Such a distinction is often not recognized in the earlier literature."

A number of technical publications dealing with the titanium aluminum compounds as well as with characteristics of these compounds are as follows:

1. E. S. Bumps, H. D. Kessler, and M. Hansen, "Titanium-Aluminum System", *Journal of Metals*, , June, 1952, pp. 609-614, TRANSACTIONS AIME, Vol. 194.
2. H. R. Ogden, D. J. Maykuth, W. L. Finlay, and R. I. Jaffee, "Mechanical Properties of High Purity Ti-Al Alloys", *Journal of Metals*, Feb. 1953, pp. 267-272, TRANSACTIONS AIME, Vol. 197.
3. Joseph B. McAndrew and H. D. Kessler, "Ti-36 Pct Al as a Base for High Temperature Alloys", *Journal of Metals*, Oct., 1956, pp. 1345-1353, TRANSACTIONS AIME, Vol. 206.
4. S. M. Barinov, T. T. Nartova, Yu L. Krasulin and T. V. Mogutova, "Temperature Dependence of the Strength and Fracture Toughness of Titanium Aluminum", *Izv. Akad. Nauk SSSR*, Met., Vol. 5, 1983, p. 170.

In reference 4, Table I, a composition of titanium-36 aluminum −0.01 boron is reported and this composition is reported to have an improved ductility. This composition corresponds in atomic percent to $Ti_{50}Al_{49.97}B_{0.03}$.
5. S. M. L. Sastry, and H. A. Lispitt, "Plastic Deformation of TiAl and $Ti_3Al$", *Titanium 80* (Published by American Society for Metals, Warrendale, Pa.), Vol. 2 (1980) page 1231.
6. Patrick L. Martin, Madan G. Mendiratta, and Harry A. Lispitt, "Creep Deformation of TiAl and TiAl+W Alloys", *Metallurgical Transactions A*, Vol. 14A (Oct. 1983) pp. 2171-2174.
7. Tokuzo Tsujimoto, "Research, Development, and Prospects of TiAl Intermetallic Compound Alloys", *Titanium and Zirconium*, Vol. 33, No. 3, 159 (July 1985) pp. 1-13.
8. H. A. Lispitt, "Titanium Aluminides—An Overview", *Mat. Res. Soc. Symposium Proc.*, Materials Research Society, Vol. 39 (1985) pp. 351-364.
9. S. H. Whang et al., "Effect of Rapid Solidification in $Ll_0$TiAl Compound Alloys", ASM Symposium Proceedings on Enhanced Properties in Struc. Metals Via Rapid Solidification, *Materials Week* (Oct. 1986) pp. 1-7.
10. Izvestiya Akademii Nauk SSR, *Metally*. No. 3 (1984) pp. 164-168.
11. P. L. Martin, H. A. Lispitt, N. T. Nuhfer and J. C. Williams, "The Effects of Alloying on the Microstructure and Properties of $Ti_3Al$ and TiAl", *Titanium 80* (published by the American Society of Metals, Warrendale, Pa.), Vol. 2 (1980) pp. 1245-1254.
12. D. E. Larsen, M. L. Adams, S. L. Kampe, L. Christodoulou, and J. D. Bryant, "Influence of Matrix Phase Morphology on Fracture Toughness in a Discontinuously Reinforced XD TM Titanium Aluminide Composite", *Scripta Metallurgica et Materialia*, Vol. 24, (1990) pp. 851-856.
13. Akademii Nauk Ukrain SSR, *Metallofiyikay* No. 50 (1974).
14. J. D. Bryant, L. Christodon, and J. R. Maisano, "Effect of $TiB_2$ Additions on the Colony Size of Near Gamma Titanium Aluminides", *Scripta Metallurgica et Materialia*, Vol. 24 (1990) pp. 33-38.

A number of other patents also deal with TiAl compositions as follows:

U.S. Pat. No. 3,203,794 to Jaffee discloses various TiAl compositions.

Canadian Patent 621884 to Jaffee similarly discloses various compositions of TiAl.

U.S. Pat. No. 4,661,316 (Hashimoto) teaches titanium aluminide compositions which contain various additives.

U.S. Pat. No. 4,842,820, assigned to the same assignee as the subject application, teaches the incorporation of boron to form a tertiary TiAl composition and to improve ductility and strength.

U.S. Pat. No. 4,639,281 to Sastry teaches inclusion of fibrous dispersoids of boron, carbon, nitrogen, and mixtures thereof or mixtures thereof with silicon in a titanium base alloy including Ti-Al.

European patent application 0275391 to Nishiejama teaches TiAl compositions containing up to 0.3 weight percent boron and 0.3 weight percent boron when nickel and silicon are present. No niobium is taught to be present in a combination with boron.

U.S. Pat. No. 4,774,052 to Nagle concerns a method of incorporating a ceramic, including boride, in a matrix by means of an exothermic reaction to impart a second phase material to a matrix material including titanium aluminides.

BRIEF DESCRIPTION OF THE INVENTION

It is, accordingly, one object of the present invention to provide a casting gamma TiAl intermetallic compound which have a fine grain structure.

Another object is to provide a method which permits gamma TiAl casting with a fine grain structure and a desirable combination of properties.

Another object is to provide a composition casting of gamma TiAl having reproducible fine grain structure when cast.

Another object is to provide castings of gamma TiAl which have a desirable set of properties as well as a fine microstructure.

Other objects and advantages of the present invention will be in part apparent and in part pointed out in the description which follows.

In one of its broader aspects, the objects of the present invention can be achieved by providing a melt of a gamma TiAl containing between 43 and 48 atom percent aluminum between 6 and 16 atom percent niobium and adding boron as an inoculating agent at concentrations of between 0.5 and 2.0 atom percent.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
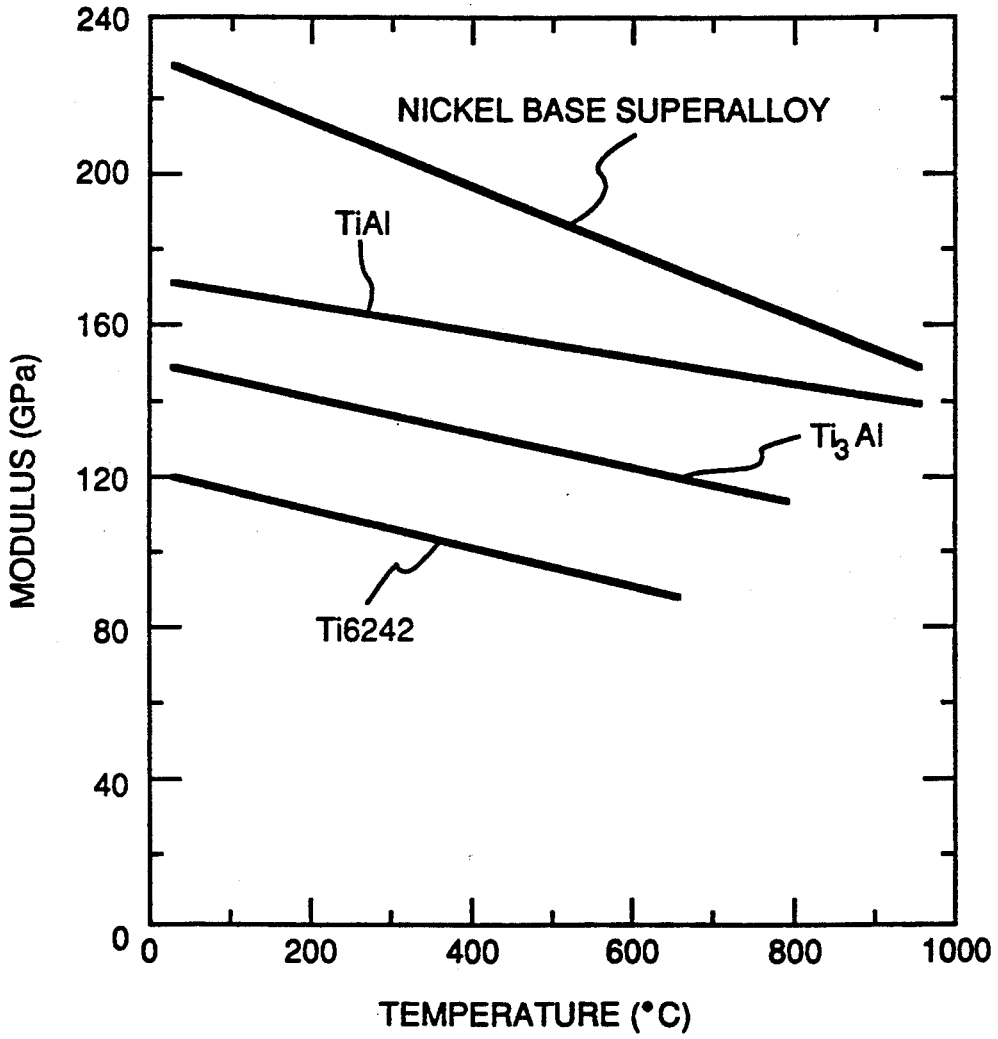
FIG. 1 is a graph illustrating the relationship between modulus and temperature for an assortment of alloys.
Figure 2:
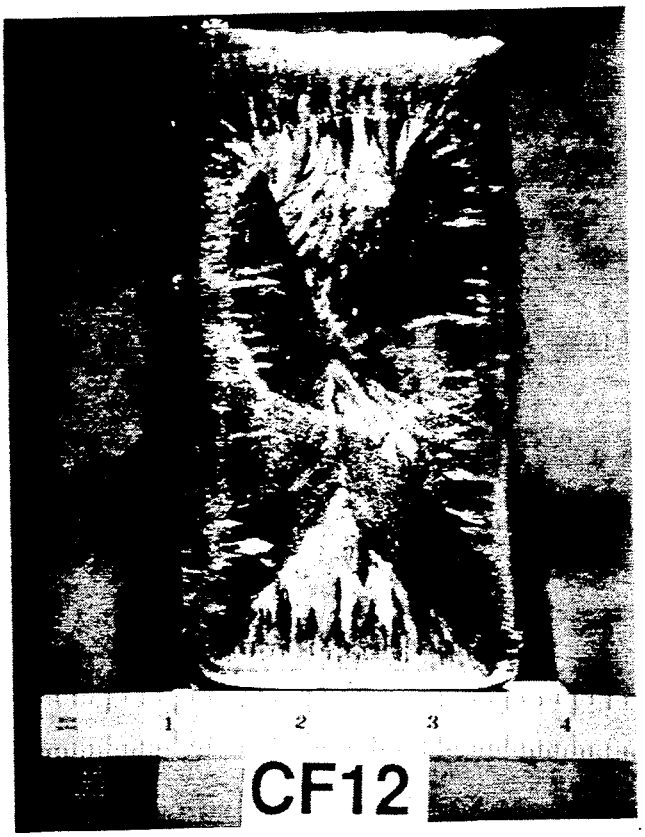
FIG. 2 is a macrograph of a casting of Ti-48Al (Example 2).
Figure 3:
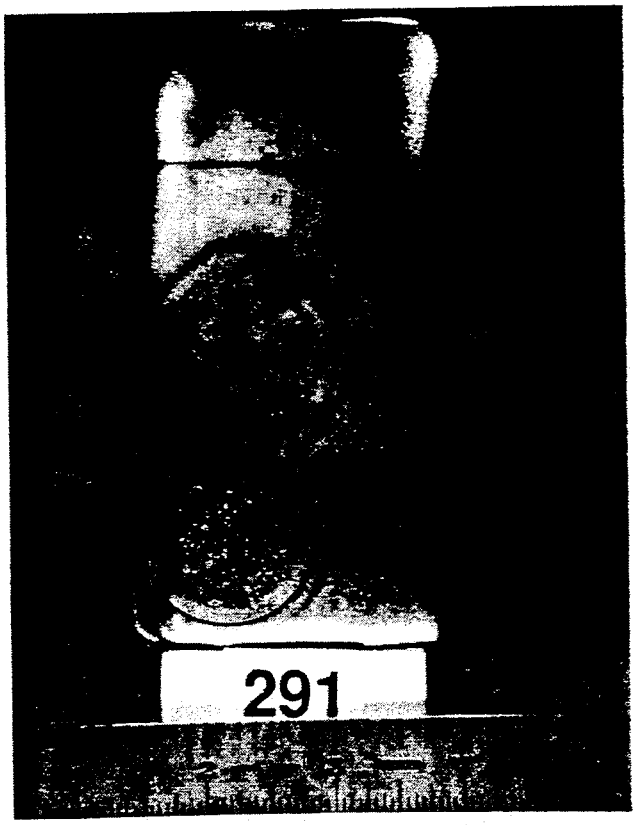
FIG. 3 is a macrograph of a casting of Ti-45.25Al-8Nb-1.5B (Example 24).

It is well known, as is extensively discussed above, that except for its brittleness the intermetallic compound gamma TiAl would have many uses in industry because of its light weight, high strength at high temperatures and relatively low cost. The composition would have many industrial uses today if it were not for this basic property defect of the material which has kept it from such uses for many years.

Further, it has been recognized that cast gamma TiAl suffers from a number of deficiencies some of which have also been discussed above. These deficiencies include the absence of a fine microstructure; the absence of a low viscosity adequate for casting in thin sections; the brittleness of the castings which are formed; the relatively poor strength of the castings which are formed; and a low fluidity in the molten state adequate to permit castings of fine detail and sharp angles and corners in a cast product.

The inventor has now found that substantial improvements in the castability of gamma TiAl and substantial improvements in the cast products can be achieved by modifications of the casting practice as now herein discussed.

To better understand the improvements in the properties of gamma TiAl, a number of examples are presented and discussed here before the examples which deal with the novel processing practice of this invention.

EXAMPLES 1-3

Three individual melts were prepared to contain titanium and aluminum in various binary stoichiometric ratios approximating that of TiAl. Each of the three compositions was separately cast in order to observe the microstructure. The samples were cut into bars and the bars were separately HIPed (hot isostatic pressed) at 1050° C. for three hours under a pressure of 45 ksi. The bars were then individually subjected to different heat treatment temperatures ranging from 1200° to 1375° C. Conventional test bars were prepared from the heat treated samples and yield strength, fracture strength and plastic elongation measurements were made. The observations regarding solidification structure, the heat treatment temperatures and the values obtained from the tests are included in Table I.

TABLE I

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 1 | Ti—46Al | large equiaxed | 1200 | 49 | 58 | 0.9 |
| | | | 1225 | * | 55 | 0.1 |
| | | | 1250 | * | 56 | 0.1 |
| | | | 1275 | 58 | 73 | 1.8 |
| 2 | Ti—48Al | columnar | 1250 | 54 | 72 | 2.0 |
| | | | 1275 | 51 | 66 | 1.5 |
| | | | 1300 | 56 | 68 | 1.3 |
| | | | 1325 | 53 | 72 | 2.1 |
| 3 | Ti—50Al | columnar-equiaxed | 1250 | 33 | 42 | 1.1 |
| | | | 1325 | 34 | 45 | 1.3 |
| | | | 1350 | 33 | 39 | 0.7 |
| | | | 1375 | 34 | 42 | 0.9 |

* — specimens failed elastically

As is evident from Table I, the three different compositions contain three different concentrations of aluminum and specifically 46 atomic percent aluminum; 48 atomic percent aluminum; and 50 atomic percent aluminum. The solidification structure for these three separate melts are also listed in Table I, and as is evident from the table, three different structures were formed on solidification of the melt. These differences in crystal form of the castings confirm in part the sharp differences in crystal form and properties which result from small differences in stoichiometric ratio of the gamma TiAl compositions. The Ti-46Al was found to have the best crystal form among the three castings but small equiaxed form is preferred.

Regarding the preparation of the melt and the solidification, each separate ingot was electroarc melted in an argon atmosphere. A water cooled hearth was used as the container for the melt in order to avoid undesirable melt-container reactions. Care was used to avoid exposure of the hot metal to oxygen because of the strong affinity of titanium for oxygen.

Bars were cut from the separate cast structures. These bars were HIPed and were individually heat treated at the temperatures listed in the Table I.

The heat treatment was carried out at the temperature indicated in the Table I for two hours.

From the test data included in Table I, it is evident that the alloys containing 46 and 48 atomic percent aluminum had generally superior strength and generally superior plastic elongation as compared to the alloy composition prepared with 50 atomic percent aluminum. The alloy having the best overall ductility was that containing 48 atom percent aluminum.

However, the crystal form of the alloy with 48 atom percent aluminum in the as cast condition did not have a desirable cast structure inasmuch as it is generally desirable to have fine equiaxed grains in a cast structure in order to obtain the best castability in the sense of having the ability to cast in thin sections and also to cast with fine details such as sharp angles and corners.

EXAMPLES 4–6

The present inventor found that the gamma TiAl compound could be substantially ductilized by the addition of a small amount of chromium. This finding is the subject of a U.S. Pat. No. 4,842,819.

A series of alloy compositions were prepared as melts to contain various concentrations of aluminum together with a small concentration of chromium. The alloy compositions cast in these experiments are listed in Table II immediately below. The method of preparation is essentially that described with reference to Examples 1–3 above.

TABLE II

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 4 | Ti—46Al—2Cr | large equiaxed | 1225 | 56 | 64 | 0.5 |
| | | | 1250 | 44 | 53 | 1.0 |
| | | | 1275 | 50 | 59 | 0.7 |
| 5 | Ti—48Al—2Cr | columnar | 1250 | 45 | 60 | 2.2 |
| | | | 1275 | 47 | 63 | 2.1 |
| | | | 1300 | 47 | 62 | 2.0 |
| | | | 1325 | 53 | 68 | 1.9 |
| 6 | Ti—50Al—2Cr | columnar-equiaxed | 1275 | 50 | 60 | 1.1 |
| | | | 1325 | 50 | 63 | 1.4 |
| | | | 1350 | 51 | 64 | 1.3 |
| | | | 1375 | 50 | 58 | 0.7 |

The crystal form of the solidified structure was observed and, as is evident from Table II the addition of chromium did not improve the mode of solidification of the structure of the materials cast and listed in Table I. In particular, the composition containing 46 atomic percent of aluminum and 2 atomic percent of chromium had large equiaxed grain structure. By way of comparison, the composition of Example 1 also had 46 atomic percent of aluminum and also had large equiaxed crystal structure. Similarly for Examples 5 and 6, the addition of 2 atomic percent chromium to the composition as listed in Examples 2 and 3 of Table I showed that there was no improvement in the solidification structure.

Bars cut from the separate cast structures were HIPed and were individually heat treated at temperatures as listed in Table II. Test bars were prepared from the separately heat treated samples and yield strength, fracture strength and plastic elongation measurements were made. In general, the material containing 46 atomic percent aluminum was found to be somewhat less ductile than the materials containing 48 and 50 atomic percent aluminum but otherwise the properties of the three sets of materials were essentially equivalent with respect to tensile strength.

EXAMPLES 7–9

Melts of three additional compositions of gamma TiAl were prepared with compositions as listed in Table III immediately below. The preparation was in accordance with the procedures described above with reference to Examples 1–3. Elemental boron was mixed into the charge to be melted to make up the boron concentration of each boron containing alloy. For convenience of reference, the composition and test data of Example 2 is copied into Table III.

TABLE III

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 2 | Ti—48Al | columnar | 1250 | 54 | 72 | 2.0 |
| | | | 1275 | 51 | 66 | 1.5 |
| | | | 1300 | 56 | 68 | 1.3 |
| | | | 1325 | 53 | 72 | 2.1 |
| 7 | Ti—48Al—0.1B | columnar | 1275 | 53 | 68 | 1.5 |
| | | | 1300 | 54 | 71 | 1.9 |
| | | | 1325 | 55 | 69 | 1.7 |
| | | | 1350 | 51 | 65 | 1.2 |
| 8 | Ti—48Al—2Cr—4Nb—0.1B | columnar | 1275 | 54 | 72 | 2.1 |
| | | | 1300 | 56 | 73 | 1.9 |
| | | | 1325 | 59 | 77 | 1.9 |
| | | | 1350 | 64 | 78 | 1.5 |
| 9 | Ti—48Al—2Cr—4Nb—0.2B | columnar | 1275 | 52 | 69 | 2.0 |
| | | | 1300 | 55 | 71 | 1.6 |

TABLE III-continued

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| | | | 1325 | 58 | 72 | 1.4 |

Each of the melts were cast and the crystal form of the castings was observed. Bars were cut from the casting and these bars were HIPed and were then given individual heat treatments at the temperatures listed in the Table III. Tests of yield strength, fracture strength and plastic elongation were made and the results of these tests are included in the Table III as well.

As is evident from the Table III, relatively low concentrations of boron of the order of one tenth or two tenths of an atom percent were employed. As is also evident from the table, this level of boron additive was not effective in altering the crystalline form of the casting.

The table includes as well a listing of the ingredients of Example 2 for convenience of reference with respect to the new Examples 7, 8, and 9 inasmuch as each of the boron containing compositions of the examples contained 48 atomic percent of the aluminum constituent.

It is important to observe that the additions of the low concentrations of boron did not result in any significant reduction of the values of the tensile and ductility properties.

EXAMPLES 10–13

Melts of four additional compositions of gamma TiAl were prepared with compositions as listed in Table IV immediately below. The preparation was according to the procedures described above with reference to Examples 1–3. In Examples 12 and 13, as in Examples 7–9, the boron concentrations were added in the form of elemental boron into the melting stock.

yield strength, fracture strength and plastic elongation are also made and these test results are included in Table IV for each of the specimens tested under each Example.

It will be noted that the compositions of the specimens of the Examples 10–13 corresponded closely to the composition of the sample of Example 4 in that each contained approximately 46 atomic percent of aluminum and 2 atomic percent of chromium. Additionally, a quaternary additive was included in each of the examples. For Example 10, the quaternary additive was carbon and as is evident from Table IV the additive did not significantly benefit the solidification structure inasmuch as a columnar structure was observed rather than the large equiaxed structure of Example 4. In addition, while there was an appreciable gain in strength for the specimens of Example 10, the plastic elongation was reduced to a sufficiently low level that the samples were essentially useless.

Considering next the results of Example 11, it is evident that the addition of 0.5 nitrogen as the quaternary additive resulted in substantial improvement in the solidification structure in that it was observed to be fine equiaxed structure. However, the loss of plastic elongation meant that the use of nitrogen was unacceptable because of the deterioration of tensile properties which it produced.

Considering the next Examples 12 and 13, here again the quaternary additive, which in both cases was boron, resulted in a fine equiaxed solidification structure thus improving the composition with reference to its casta-

TABLE IV

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 4 | Ti—46Al—2Cr | large equiaxed | 1225 | 56 | 64 | 0.5 |
| | | | 1250 | 44 | 53 | 1.0 |
| | | | 1275 | 50 | 59 | 0.7 |
| 10 | Ti—46Al—2Cr—0.5C | columnar | 1250 | 97 | 97 | 0.2 |
| | | | 1300 | 86 | 86 | 0.2 |
| | | | 1350 | 69 | 73 | 0.3 |
| | | | 1400 | 96 | 100 | 0.3 |
| 11 | Ti—46.5Al—2Cr—0.5N | fine, equiaxed | 1250 | + | 77 | 0.1 |
| | | | 1300 | 73 | 75 | 0.2 |
| | | | 1350 | + | 60 | 0.1 |
| | | | 1400 | + | 80 | 0.1 |
| 12 | Ti—45.5Al—2Cr—1B | fine, equiaxed | 1250 | 77 | 85 | 0.5 |
| | | | 1275 | 76 | 85 | 0.7 |
| | | | 1300 | 75 | 89 | 1.0 |
| | | | 1325 | 71 | 80 | 0.5 |
| | | | 1350 | 78 | 85 | 0.4 |
| 13 | Ti—45.25Al—2Cr—1.5B | fine, equiaxed | 1250 | 81 | 88 | 0.5 |
| | | | 1300 | 79 | 85 | 0.4 |
| | | | 1350 | 83 | 94 | 0.7 |

+ — specimens failed elastically

Again, following the formation of each of the melts of the four examples, observation of the solidification structure was made and the structure description is recorded in Table IV. The data for Example 4 is copied into Table IV to make comparison of data with the Ti-46Al-2Cr composition more convenient. In addition, bars were prepared from the solidified sample, the bars were HIPed, and given individual heat treatments at temperatures ranging from 1250° to 1400° C. Tests of bility. In addition, a significant gain in strength resulted from the boron addition based on a comparison of the values of strength found for the samples of Example 4 as stated above. Also very significantly, the plastic elongation of the samples containing the boron quaternary additive were not decreased to levels which rendered the compositions essentially useless. Accordingly, I have found that by adding boron to the titanium aluminide containing the chromium ternary additive I am able not only to substantially improve the solidification structure, but am also able to significantly improve tensile properties including both the yield strength and fracture strength without unacceptable loss of plastic elongation. I have discovered that beneficial results are obtainable from additions of higher concentrations of boron where the concentration levels of aluminum in the titanium aluminide are lower. Thus the gamma titanium aluminide composition containing chromium and boron additives are found to very significantly improve the castability of the titanium aluminide based composition particularly with respect to the solidification structure and with respect to the strength properties of the composition. The improvement in cast crystal form occurred for the alloy of Example 13 as well as of Example 12. However, the plastic elongation for the alloy of Example 13 were not as high as those for the alloy of Example 12.

EXAMPLES 14–23

A set of 10 additional alloy compositions were prepared having ingredient content as set forth in Table V immediately below. The method of preparation was essentially as described in Examples 1–3 above. No elemental boron or other source of boron was employed in preparing any of these 10 compositions.

addition of higher concentration of niobium induces formation of equiaxed crystal structure.

Following the steps set forth with reference to Examples 1–3 above, bars of the cast material were prepared, HIPed, and individually heat treated at the temperatures listed in Table V under the heading "Heat Treat Temperature (°C.)". The test bars were prepared from the bars of cast material and were tested. The results of the tests are listed in Table V with respect to both strength properties and with respect to plastic elongation.

In general, it will be observed that essentially none of the samples tested had a desirable combination of strength and ductility which exceeded that of the base alloy. Thus, for example, the tests preformed on the material of Example 14 containing 48 atom percent aluminum did not exceed the strength and ductility combination of properties of the material of Example 2 above which also contain 48 atom percent of aluminum. The heat treatment of the samples as listed in Table V was about two hours and this corresponded to the two hour heat treatment of the samples of Table I and of the other various tables listed above.

In general, therefore, the compositions as listed in Table V did not provide significant advantage over the base compositions or other compositions containing titanium, aluminum, and niobium.

For example, the compositions of Example 16 had

TABLE V

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 14 | Ti—48Al—6Nb | columnar | 1275 | 58 | 69 | 1.2 |
| | | | 1300 | 54 | 68 | 1.6 |
| | | | 1325 | 53 | 70 | 1.9 |
| 15 | Ti—50Al—6Nb | columnar | 1325 | 34 | 44 | 1.4 |
| | | | 1350 | 40 | 48 | 0.9 |
| | | | 1375 | 43 | 52 | 1.1 |
| 16 | Ti—44Al—10Nb | equiaxed | 1250 | 109 | 109 | 0.2 |
| | | | 1300 | —* | 100 | 0.1 |
| | | | 1350 | —* | 102 | 0 |
| 17 | Ti—46Al—10Nb | large, equiaxed | 1250 | 98 | 99 | 0.3 |
| | | | 1300 | 90 | 90 | 0.2 |
| | | | 1350 | —* | 76 | 0 |
| 18 | Ti—48Al—10Nb | columnar | 1275 | 62 | 69 | 0.7 |
| | | | 1300 | 60 | 71 | 1.2 |
| | | | 1325 | 59 | 71 | 1.2 |
| 19 | Ti—44Al—12Nb | equiaxed | 1250 | —* | 96 | 0 |
| | | | 1300 | —* | 105 | 0.1 |
| | | | 1350 | —* | 117 | 0 |
| 20 | Ti—46Al—12Nb | equiaxed | 1250 | —* | 96 | 0.1 |
| | | | 1300 | —* | 95 | 0.1 |
| | | | 1350 | —* | 100 | 0.1 |
| 21 | Ti—50Al—12Nb | columnar | 1325 | 45 | 50 | 0.6 |
| | | | 1350 | 45 | 53 | 1.0 |
| | | | 1375 | 47 | 57 | 1.2 |
| 22 | Ti—44Al—16Nb | equiaxed | 1250 | —* | 98 | 0 |
| | | | 1300 | —* | 92 | 0 |
| | | | 1350 | 104 | 104 | 0.2 |
| 23 | Ti—48Al—16Nb | large, equiaxed | 1275 | —* | 61 | 0 |
| | | | 1300 | —* | 59 | 0 |
| | | | 1325 | 64 | 68 | 0.3 |

+ — specimens failed elastically

As is evident from Table V, the compositions which were prepared had different ratios of titanium and aluminum and also had varying quantities of the niobium additive extending from about 6 to about 16 atom percent. As is evident from the column labeled "Solidification Structure", the compositions containing 44 atom percent aluminum are listed as having a fine grain equiaxed structure while those containing 50 atom percent aluminum are listed as having columnar structure. Further, a comparison of Examples 18 and 23 reveals that quite high fracture strength but the plastic elongation was so low as to essentially render these compositions useless. Similarly, the compositions of Example 17 had a combination of higher strength but poorer ductility. Note that these two alloys contain relatively low Al concentrations. The compositions of Examples 21 and 15 had acceptable ductility values but had relatively lower levels of strength. Note that these alloys contain 50 atomic percent Al.

Low-Al alloys tend to have the desirable equiaxed structure and high strength, but ductilities are unacceptably low.

EXAMPLE 24

One additional alloy composition was prepared having an ingredient content as set forth in Table VI immediately below. The method of preparation was essentially as described in Examples 1-3 above. As in the earlier examples which contain boron, the elemental boron was mixed into the charge to be melted to make up the boron concentration of the boron containing alloy.

The test results for the alloys of the Examples 16, 17 and 18 demonstrate that as aluminum content is increased ductility is also increased but that simultaneously the increase in aluminum content decreases strength.

It should also be pointed out that the presence of niobium has been found to be helpful with respect to oxidation resistance of the alloy composition as pointed out more fully in copending application Ser. No. 07/445/306, filed Dec. 4, 1989.

TABLE VI

| Example Number | Alloy Composition (at %) | Solidification Structure | Heat Treat Temperature (°C.) | Yield Strength (ksi) | Fracture Strength (ksi) | Plastic Elongation (%) |
|---|---|---|---|---|---|---|
| 24 | Ti—45.25Al—8Nb—1.5B | fine equiaxed | 1275 | 83 | 101 | 1.6 |
| | | | 1300 | 88 | 104 | 1.3 |
| | | | 1325 | 86 | 102 | 1.0 |
| | | | 1350 | 92 | 101 | 0.6 |

As is evident from Table VI, the composition of the alloy of Example 24 is a composition similar to that of the examples 14-23 in that it contained titanium and aluminum and also contained a relatively high concentration of niobium additive. In addition, the composition contained 1.5 atom percent of boron.

As is evident from the listing under "Solidification Structure" the alloy had a fine equiaxed structure in contrast to the columnar type of structure of some of the alloys of Table V.

Following the steps set forth with reference to Examples 1-3, the bars of the cast material were prepared, HIPed, and individually heat treated at the temperatures listed in Table VI. The test bars were prepared and tested and the results of the tests are listed in Table VI with respect to both strength properties and with respect to plastic elongation. As is evident from the data listed in Table VI, dramatic improvements, particularly in the combination of strength with plastic elongation were found for the compositions of Example 24.

Thus, although the composition of Example 24 containing 8 atom percent of niobium does not correspond exactly to a composition of Table V, nevertheless the compositions of Table V, and particularly those containing 6 atom percent niobium and 10 atom percent of niobium were not found to possess a combination of strength and plastic elongation which matched that of the alloy, for example, 24.

Figure 4:
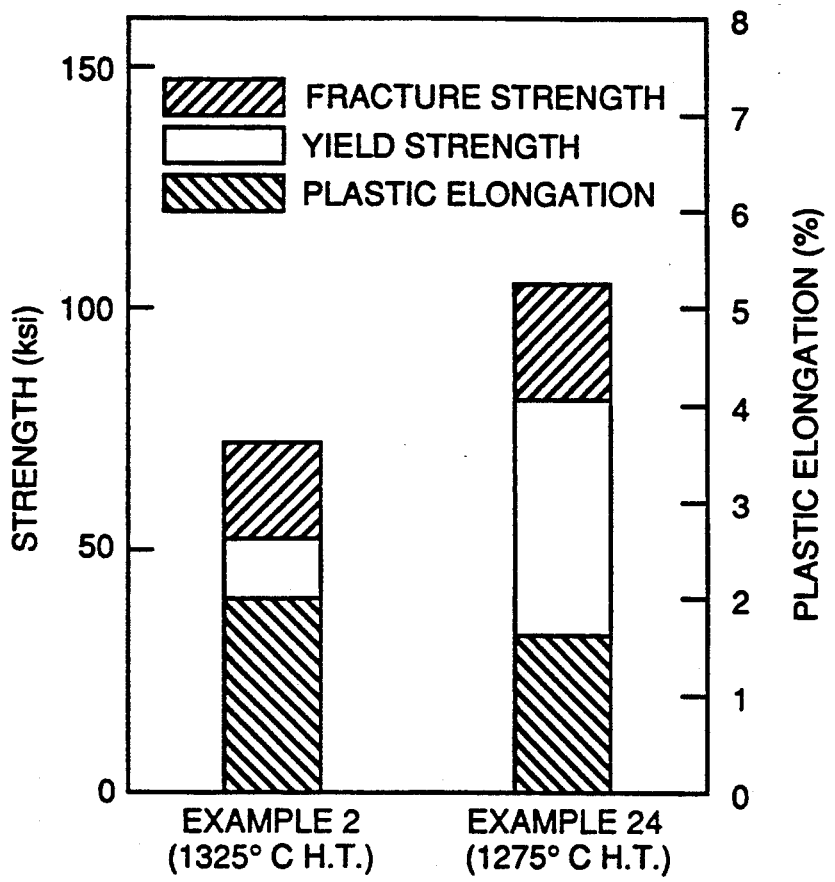
FIG. 4 is a bar graph illustrating the property differences between the alloys of FIGS. 2 and 3.

The improvement in the combinations of properties of the compositions of Example 24 are plotted graphically in FIG. 4 where a comparison is made between the properties of the alloy of Example 2 with the properties of the alloy of Example 24.

It should also be pointed out that the findings of the superior properties of the composition of Example 24 are all the more surprising when a comparison is made with other compositions to which boron had been added and particularly the alloys of Examples 12 and 13. Obviously, these properties are very sensitive to the presence of other alloying additives as the properties of the chromium containing compositions are very inferior to those of the composition of Example 24.

What is claimed is:

1. A castable composition comprising titanium, aluminum, niobium, and boron in the following approximate composition:

$$Ti_{34-50.5}Al_{43-48}Nb_{6-16}B_{0.5-2.0}.$$

2. A castable composition comprising titanium, aluminum, niobium, and boron in the following approximate composition:

$$Ti_{34.5-50}Al_{43-48}Nb_{6-16}B_{1.0-1.5}.$$

3. A castable composition comprising titanium, aluminum, niobium, and boron in the following approximate composition:

$$Ti_{38-50.5}Al_{43-48}Nb_{6-12}B_{0.5-2.0}.$$

4. A castable composition comprising titanium, aluminum, niobium, and boron in the following approximate composition:

$$Ti_{40-48.5}Al_{44.5-46.5}Nb_{6-12}B_{1.0-1.5}.$$

5. A castable composition comprising titanium, aluminum, niobium, and boron in the following approximate composition:

$$Ti_{41.5-47}Al_{44.5-46.5}Nb_{8-10}B_{0.5-2.0}.$$

6. A castable composition comprising titanium, aluminum, niobium, and boron in the following approximate composition:

$$Ti_{42-46.5}Al_{44.5-46.5}Nb_{8-10}B_{1.0-1.5}.$$

7. A structural element, said element being a casting of a composition having the following approximate composition:

$$Ti_{34-50.5}Al_{43-48}Nb_{6-16}B_{0.5-2.0}.$$

8. A structural element, said element being a casting of a composition having the following approximate composition:

$$Ti_{34.5-50}Al_{43-48}Nb_{6-16}B_{1.0-1.5}.$$

9. A structural element, said element being a casting of a composition having the following approximate composition:

$Ti_{38-50.5}Al_{43-48}Nb_{6-12}B_{0.5-2.0}$.

10. A structural element, said element being a casting of a composition having the following approximate composition:

$Ti_{40-48.5}Al_{44.5-46.5}Nb_{6-12}B_{1.0-1.5}$.

11. A structural element, said element being a casting of a composition having the following approximate composition:

$Ti_{41.5-47}Al_{44.5-46.5}Nb_{8-10}B_{0.5-2.0}$.

12. A structural element, said element being a casting of a composition having the following approximate composition:

$Ti_{42-46.5}Al_{44.5-46.5}Nb_{8-10}B_{1.0-1.5}$.

* * * * *